US007345261B2

(12) United States Patent
Oh et al.

(10) Patent No.: US 7,345,261 B2
(45) Date of Patent: Mar. 18, 2008

(54) WALL-MOUNTED MICROWAVE OVEN

(75) Inventors: Keun-Seuk Oh, Suwon-si (KR); Sang-Seok Seo, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 11/017,936

(22) Filed: Dec. 22, 2004

(65) Prior Publication Data

US 2005/0173420 A1 Aug. 11, 2005

(30) Foreign Application Priority Data

Jan. 27, 2004 (KR) ..... 10-2004-0004940

(51) Int. Cl.
*H05B 6/64* (2006.01)
*F24C 15/32* (2006.01)

(52) U.S. Cl. ..... 219/681; 126/21

(58) Field of Classification Search ..... 219/681, 219/400, 757; 126/21, 22, 19, 21 R, 19 R
See application file for complete search history.

(56) References Cited

U.S. PATENT DOCUMENTS 3,586,516 A * 6/1971 Terc ..... 219/400
3,991,295 A * 11/1976 Akiyoshi ..... 219/751
4,286,134 A * 8/1981 Nakata et al. ..... 219/711
4,296,297 A * 10/1981 Miller ..... 219/751
4,379,964 A * 4/1983 Kanazawa et al. ..... 219/492
4,447,693 A * 5/1984 Buck ..... 219/705
4,481,394 A * 11/1984 Tanabe ..... 219/685
4,794,219 A 12/1988 Eke
4,908,488 A 3/1990 Park
6,469,287 B1 * 10/2002 Kim ..... 219/751

FOREIGN PATENT DOCUMENTS

EP 0358344 3/1990
JP 11-166737 6/1999

OTHER PUBLICATIONS

European Search Report for corresponding Application No. 04256485.6-2214 dated Apr. 2005.
Chinese Office Action for corresponding Application No. 200410087376 dated Sep. 22, 2006.

* cited by examiner

*Primary Examiner*—Daniel Robinson
(74) *Attorney, Agent, or Firm*—Staas & Halsey LLP

(57) ABSTRACT

A wall-mounted microwave oven including a cooking chamber, a heater casing, a heater installed in the heater case, a blowing fan to supply hot air generated in accordance with a heating operation of the heater, first guide members to guide the hot air, supplied by the blowing fan, to be introduced into the cooking chamber, and second guide members to guide the hot air to circulate along the heater. The first and second guide members allow hot air to be rapidly introduced into the cooking chamber while being rapidly heated to a desired high temperature. Also, the hot air can effectively circulate in the cooking chamber. Accordingly, it is possible to reduce a cooking time and enhance cooking efficiency.

13 Claims, 2 Drawing Sheets

WALL-MOUNTED MICROWAVE OVEN

CROSS-REFERENCE TO RELATED APPLICATIONS

This application claims the benefit of Korean Patent Application No. 2004-4940, filed on Jan. 27, 2004 in the Korean Intellectual Property Office, the disclosure of which is incorporated herein by reference.

BACKGROUND OF THE INVENTION

1. Field of the Invention

The present invention relates to a wall-mounted microwave oven, and more particularly, to a wall-mounted microwave oven including an air guide to feed hot air to a cooking chamber.

2. Description of the Related Art

Generally, a wall-mounted microwave oven is mounted over another cooling appliance such as a gas oven installed on a kitchen sink in a kitchen space. Such a wall-mounted microwave oven not only performs a cooking function using microwaves, similarly to that of general microwave ovens, but also performs a function for externally exhausting fumes, smoke or smell of food rising from another cooling appliance during a cooking operation for the food.

Similarly to general microwave ovens, a wall-mounted microwave oven includes a cooking chamber and an electric element chamber partitioned in the interior of an oven body defining the appearance of the microwave oven, to cook food in the cooking chamber. Exhaust passages are defined between facing walls of the oven body and cooking chamber and between facing walls of the oven body and electric element chamber, respectively. The microwave oven also includes an exhaust fan arranged at a rear upper portion of the oven body, and communicating with the exhaust passages. With this configuration, the microwave oven can suck fumes, smoke and food odor rising beneath the oven body through the exhaust passages in accordance with an operation of the exhaust fan, and then exhaust them to the exterior.

For such a wall-mounted microwave oven, a convection type microwave oven has been known. The present invention relates to a convection type microwave oven. As disclosed in Korean Utility Model No. 20-0327751, such a convection type microwave oven includes an electric heater for generating heat by use of electric resistance, and a convection fan, which are arranged in a rear of a cooking chamber. With this configuration, the convection type microwave oven not only has a food cooking function using microwaves, as in general microwave ovens, but also directly heats the surface of food by use of heat generated from the electric heater, thereby reducing the cooking time while efficiently achieving the cooking operation.

In such a conventional microwave oven, however, air is supplied into the cooking chamber before being sufficiently heated by the heater because the convection fan is mounted to a heater casing in a rear of the electric heater such that it is arranged just near the electric heater. For this reason, there is a problem in that the temperature of the supplied hot air is low, so that the cooking efficiency of the microwave oven is degraded.

Furthermore, the hot air is introduced, at a time, into the cooking chamber through an inlet arranged in front of the heater. For this reason, the hot air has a low flow rate, so that it circulates ineffectively in the cooking chamber. As a result, there are problems of a large loss of heat and an increased cooking time.

SUMMARY OF THE INVENTION

Accordingly, it is an aspect of the invention to provide a wall-mounted microwave oven capable of heating hot air for a sufficient period of time, thereby increasing the temperature of the hot air, while discharging the hot air into a cooking chamber in a concentrated fashion, thereby achieving a reduction in heat loss, a reduction in cooking time, and an enhancement in cooking efficiency.

Additional aspects and/or advantages of the invention will be set forth in part in the description which follows and, in part, will be obvious from the description, or may be learned by practice of the invention.

The foregoing and/or other aspects of the present invention are achieved by providing a wall-mounted microwave oven comprising a cooking chamber, a heater casing, a heater installed in the heater casing to generate hot air, and a blowing fan to supply the hot air generated in accordance with a heating operation of the heater, and comprising a first guide member to guide the hot air, supplied by the blowing fan, to be introduced into the cooking chamber, and a second guide member to guide the hot air to circulate along the heater.

The blowing fan may be arranged inside the heater.

The first guide member may be connected with the second guide member.

The heater casing further comprises a plurality of through holes to communicate with the cooking chamber, wherein the first guide member may be arranged to extend in parallel to a direction of hot air flowing toward the through holes to guide the hot air toward the through holes, and the second guide member is arranged to extend inclinedly at a predetermined angle, to guide the hot air to circulate along the heater.

The first guide member may comprise a plurality of first guide members arranged between the heater casing and the heater while being uniformly spaced apart from each other around the heater. The second guide member may comprise a plurality of second guide members arranged between the heater casing and the heater while being uniformly spaced apart from each other around the heater.

The heater casing may be arranged at one side wall of an oven body.

The wall-mounted microwave oven may further comprise a motor arranged at a top wall of an oven body, and connected with the blowing fan via pulleys and a belt to transmit a drive force therefrom to the blowing fan.

BRIEF DESCRIPTION OF THE DRAWINGS

These and/or other aspects and advantages of the invention will become apparent and more readily appreciated from the following description of the embodiments, taken in conjunction with the drawings in which.

DETAILED DESCRIPTION OF THE PREFERRED EMBODIMENTS

Figure 1:
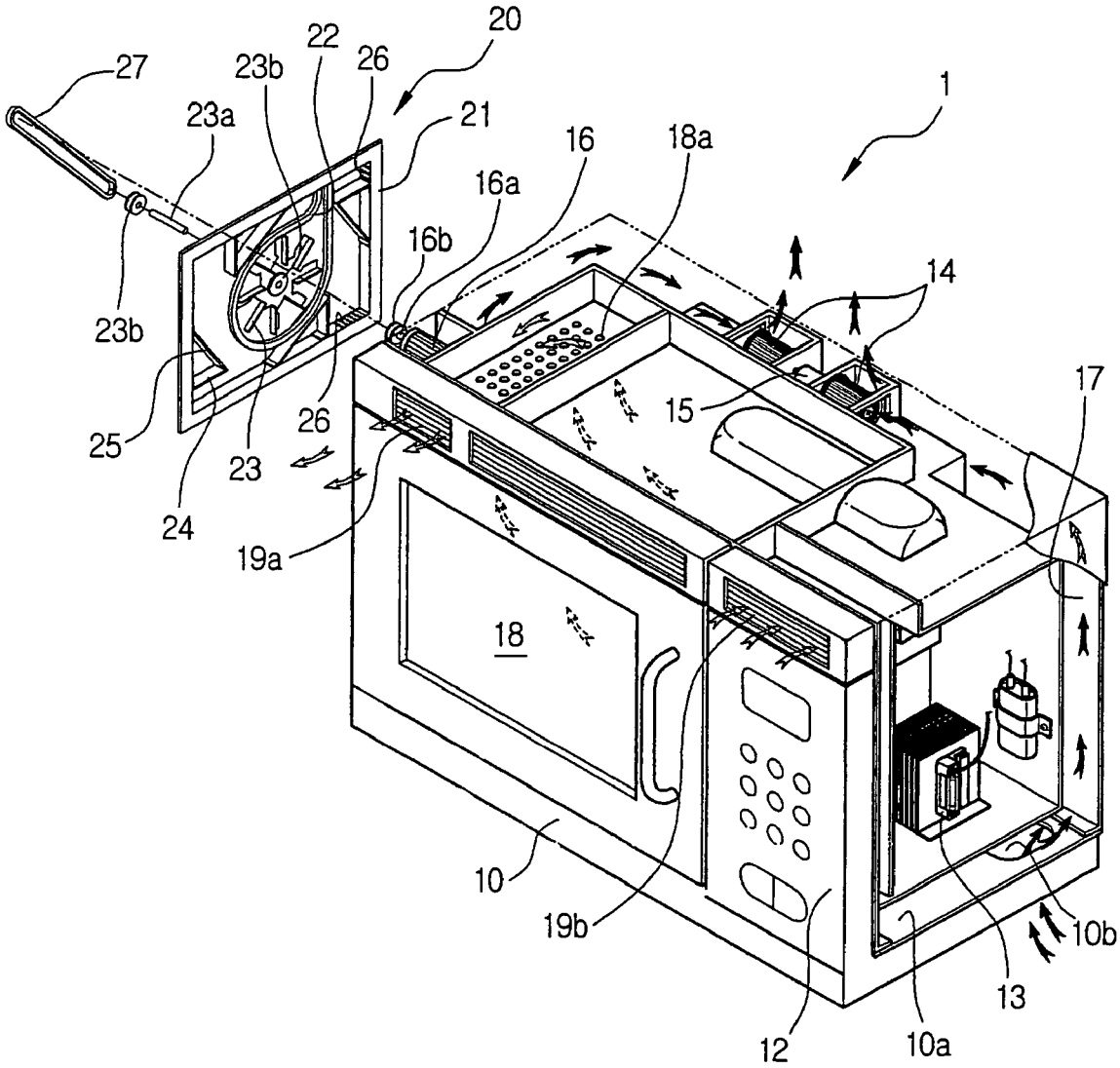
FIG. 1 is a perspective view illustrating a wall-mounted microwave oven according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

FIG. 1 is a perspective view illustrating a wall-mounted microwave oven according to an embodiment of the present invention. In FIG. 1, the wall-mounted microwave oven 1 according to the illustrated embodiment of the present invention, is typically mounted to a wall in a kitchen space. Also, a complex cooking appliance, which is provided with a plurality of gas oven ranges at the top thereof, is typically arranged beneath the microwave oven 1. Around the microwave oven 1, a plurality of sideboards may be arranged to store diverse dishes and kitchen utensils.

The microwave oven 1 cooks food using microwaves, while sucking fumes, smoke and food odor rising from the complex cooking appliance during a cooking operation thereof, and exhausting them to an exterior.

The microwave oven 1 includes an oven body 10 having a box shape to define the appearance of the microwave oven 1, a cooking chamber 18 and an electric element chamber 12, which are defined in the interior of the oven body 10 and partitioned from each other.

An exhaust passage 17 is defined in the oven body 10 along the bottoms, opposite sides and tops of the cooking chamber 18 and electric element chamber 12, in order to exhaust, to the exterior, fumes and smoke rising from the complex cooking appliance arranged beneath the oven body 10. A pair of exhaust fans 14 are installed at a rear upper portion of the oven body 10 to externally discharge exhaust gas, fumes, etc. flowing through the exhaust passage 17. A fan motor 15 is also installed at the rear upper portion of the oven body 10 to rotate the exhaust fans 14. The exhaust passage 17 is partitioned from the cooking chamber 11 and electric element chamber 12.

In the electric element chamber 12, electric elements such as a high-voltage transformer 13 are arranged. A front air inlet 19*b* is provided in a front side of the oven body 10 above the electric element 12. A front air outlet 19*a* is also provided at the oven body 10 in a front side of the oven body 10 above the cooking chamber 18. The front air inlet 19*b* and front air outlet 19*a* allow air to circulate through the electric element chamber 12 and cooking chamber 18, to cool the electric elements received in the electric element chamber 12 and to exhaust moisture and food odor existing in the cooking chamber 18. With the above described configuration, microwaves are irradiated to food placed in the cooking chamber 18, so that the food can be cooked by heat caused by the microwaves irradiated thereto.

A bottom plate 10*a* is mounted to the bottom of the oven body 10. The bottom plate 10*a* is provided with an exhaust inlet 10*b*. When the fan motor 15 operates to rotate the exhaust fans 14, exhaust gas and food odor rising beneath the oven body 10 are sucked into the exhaust passage 17 through the exhaust inlet 10*b*. After flowing through the exhaust passage 17, the sucked fumes may be exhausted to the exterior via a duct (not shown) communicating with the exterior. The fumes passing through the exhaust passage 17 may be again discharged into the kitchen space after being filtered while passing through a discharge grill 18*a* provided at the oven body 10 in a front side of the oven body 10 over the cooking chamber 18.

A convection heater unit 20 is installed at a side wall of the oven body 10 opposite to the electric element chamber 12 (i.e., a left side wall of the oven body 10) in FIG. 1. The convection heater unit 20 comprises a heater 22, a blowing fan 23, and a heater casing 21. The heater casing 21 comprises a rectangular box-shaped structure having a size equal to the corresponding side wall of the oven body 10. In the heater casing 21, the heater 22 and blowing fan 23 are installed such that the heater 22 is arranged around the blowing fan 23. The heater casing 21 is also provided with first and second guide members 24 and 25 to guide hot air discharged from the periphery of the heater 22 by the blowing fan 23.

A fan shaft 23*a* extends horizontally through the heater casing 21 and rotatably supported by the heater casing 21. The fan shaft 23*a* is coupled with the blowing fan 23 at an inner end thereof arranged inside the heater casing 21, and coupled with a pulley 23*b* at an outer end thereof arranged outside the heater casing 21. A belt 27 connected to a motor 16 is connected to the pulley 23*b*, to transmit a drive force from the motor 16 to the blowing fan 23. The motor 16 is mounted to the oven body 10 over the cooking chamber 18.

The motor 16 comprises a motor shaft 16*a* to output a rotating force from the motor 16, and a pulley 16*b* coupled to the motor shaft 16*a* and connected with the pulley 23*b* coupled to the fan shaft 23*a* via the belt 27. Accordingly, the rotating force from the motor 16 can be transmitted to the blowing fan 23 via the belt 27 connected between the pulleys 16*b* and 23*b*.

Figure 2:
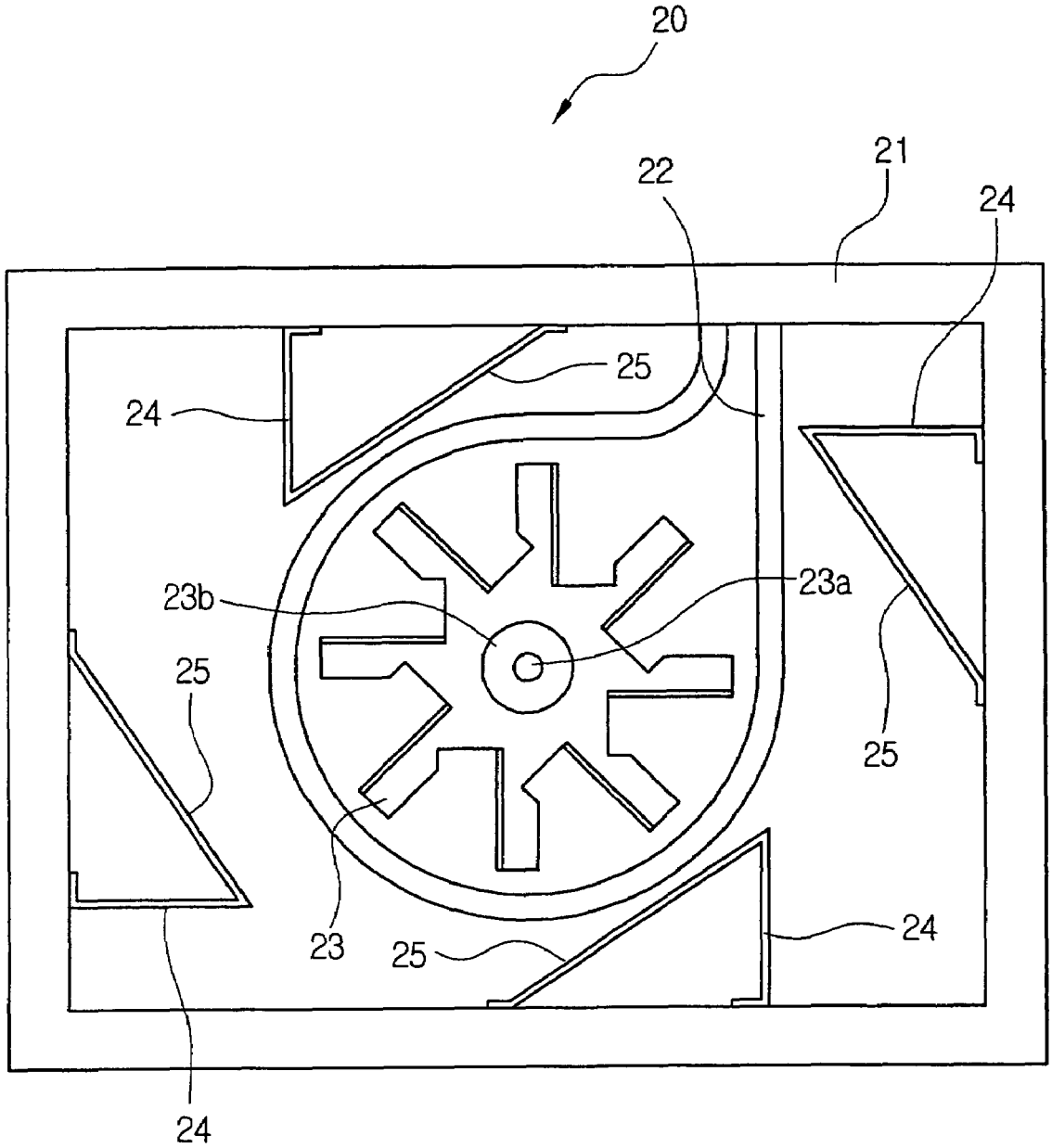
FIG. 2 is a sectional view illustrating the heater casing, to which the heater, blowing fan, and air guide members are attached, in the wall-mounted microwave oven shown in FIG. 1.

FIG. 2 is a sectional view illustrating the heater casing, to which the heater, blowing fan, and air guide members are attached, in the wall-mounted microwave oven shown in FIG. 1.

The heater casing 21 has a centrally-recessed rectangular box-shaped structure. As described above, the heater 22 is arranged inside the heater casing 2. In the illustrated embodiment of the present invention, the heater 22 has an annular structure, except for a power connection portion thereof. Of course, the heater 22 may have a structure other than the annular structure.

The blowing fan 23 is arranged inside the heater 22. The blowing fan 23 may be an axial-flow fan. The blowing fan 23 is coupled, at a central portion thereof, to the fan shaft 23*a* inside the heater casing 21, so that it is coupled with the pulley 23*b* via the fan shaft 23*a* outside the heater casing 21.

The first and second guide members 24 and 25 are mounted in multiples to the inner peripheral surface of the heater casing 21 such that they are arranged around the heater 22 while being uniformly spaced apart from each other. A plurality of through holes 26 are provided at a peripheral portion of the heater casing 21 such that they communicate with the cooking chamber 18. The through holes 26 are arranged such that they receive hot air respectively guided by the first and second air guide members 24 and 25 to supply the hot air into the cooking chamber 18. In this aspect of the present invention, each first guide member 24 is mounted, at one end thereof, to an inner peripheral surface portion of the heater casing 21 near a corresponding one of the through holes 26 while extending in parallel to a flow direction of a hot air flow directed to the corresponding through hole 26. Accordingly, each first guide member 24 guides hot air discharged at the periphery of the heater 22 toward the corresponding through hole 26. Each second guide member 25 is mounted, at one end thereof, to the inner peripheral surface portion of the heater case 21 where a corresponding one of the first guide members 24 is mounted and connected, at another end thereof, with the other end of the corresponding first guide member 24 such that the second guide member 25 extends inclinedly at a predetermined angle with respect to the inner peripheral surface portion of the heater casing 21 to face the heater 22. Each second guide member 25 serves to guide hot air, discharged from the periphery of the heater 22, to flow around the heater 22. The corresponding first and second guide members 24 and 25 form a triangular structure, along with the inner peripheral surface portion of the heater casing 21, to which they are mounted.

The first and second guide members 24 and 25 each comprises a predetermined width sufficient to allow hot air to flow along them. In accordance with guiding functions of the first and second guide members 24 and 25, hot air is introduced into the cooking chamber 18 of the oven body 10 through the through holes 26.

Now, the operation, function and effect of the wall-mounted microwave oven according to the illustrated embodiment of the present invention will be described.

As described above, the wall-mounted microwave oven comprises a structure for exhausting, to the exterior, vapor and food odor rising from the cooking appliance arranged beneath the microwave oven. This wall-mounted microwave oven not only serves as a general microwave oven having a cooking function using microwaves generated from the magnetron, but also serves as a convection type oven which receives heat from the heater to rapidly heat the surface of food, thereby rapidly cooking the food.

When electric power is supplied to the microwave oven, and a convection course is selected, the heater 22 begins to generate heat, and the blowing fan 23 begins to rotate. In accordance with the rotation of the blowing fan 23, air heated by the heater 22 is supplied into the cooking chamber 18.

The hot air discharged at the periphery of the heater 22 is partially guided by the first guide members 24 arranged along the rotating direction of the blowing fan 23 and introduced into the cooking chamber 18 through the through holes 26. A remaining part of the hot air is guided by the second guide members 25 inclined at a predetermined angle so that the hot air flows around the heater 22. The hot air flowing around the heater 22 in accordance with each second guide member 25 is then partially guided by the first guide member 24 arranged just downstream from the second guide member 25, so that it is supplied into the cooking chamber 18. A remaining part of the hot air is then guided by the downstream-side second guide member 25, so that it flows around the heater 22. Thus, the hot air discharged at the periphery of the heater 22 is partially supplied into the cooking chamber 18 while partially circulating around the heater 22.

In accordance with such a guiding function, the hot air is heated for an extended period of time, so that the temperature thereof is increased. Since the hot air is partially and sequentially supplied into the cooking chamber 18 through the through holes 26 provided at the heater casing 21 in accordance with the guiding function of the first guide members 24, the flow rate thereof is relatively high. Accordingly, the hot air can effectively circulate in the cooking chamber 18, so that there are effects of an enhancement in cooking efficiency and a reduction in cooking time.

Vapor and food odor caused by the cooking operation are externally exhausted through the front air outlet 19*a* communicating with the cooking chamber 18.

As is apparent from the above description, the wall-mounted microwave oven of the present invention comprises the first and second guide members defining a flow path around the heater. The first and second guide members, allow hot air to flow rapidly, introduced into the cooking chamber while being rapidly heated to a desired high temperature. Also, the hot air can effectively circulate in the cooking chamber. Accordingly, it is possible to achieve a reduction in cooking time and an enhancement in cooking efficiency.

Although the few embodiments of the invention have been shown and described, it would be appreciated by those skilled in the art that changes may be made in this embodiment without departing from the principles and spirit of the invention, the scope of which is defined in the claims and their equivalents.

What is claimed is:

1. A wall-mounted microwave oven comprising:

a cooking chamber;

a heater to generate hot air;

a blowing fan to supply the hot air generated by the heater to the cooking chamber;

a heater casing having the heater and the blowing fan installed therein such that the heater surrounds the blowing fan;

first guide members to guide the hot air, supplied by the blowing fan, to be introduced into the cooking chamber;

second guide members to guide and circulate the hot air along the heater;

a motor arranged at a top wall of an oven body, and connected with the blowing fan via pulleys and a belt to transmit a drive force therefrom to the blowing fan;

a fan shaft which extends horizontally through the heater casing and coupled with the blowing fan at an inner end thereof; and a pulley arranged outside of the heater casing and coupled with the fan shaft, wherein the rotating force from the motor is transmitted to the blowing fan via the belt connected between the pulley coupled to the motor shaft and the pulley arranged outside of the heater casing.

2. The wall-mounted microwave oven of claim 1, wherein the blowing fan is arranged inside the heater.

3. The wall-mounted microwave oven of claim 1, wherein each first guide member is connected with a corresponding second guide member, respectively.

4. The wall-mounted microwave oven of claim 1, wherein each first guide member is arranged to extend in parallel to a direction of hot air flowing toward a hot air inlet provided at the heater casing to communicate with the cooking chamber so that it guides the hot air toward the hot air inlet, and each second guide member is arranged to extend inclinedly at a predetermined angle so that it guides the hot air to circulate along the heater.

5. The wall-mounted microwave oven of claim 1, wherein the first guide members are arranged between the heater casing and the heater while being uniformly spaced apart from each other around the heater, and the second guide members are arranged between the heater casing and the heater while being uniformly spaced apart from each other around the heater.

6. The wall-mounted microwave oven of claim 1, wherein the heater casing is arranged at one side wall of an oven body.

7. The wall-mounted microwave of claim 1, wherein the heater casing comprises a rectangular box-shaped structure.

8. The wall-mounted microwave of claim 1, wherein the heater is of an annular shape.

9. The wall-mounted microwave of claim 1, wherein the blowing fan is an axial-flow fan.

10. A wall-mounted microwave comprising:

a cooking chamber;

a heater casing having a heater installed therein to generate hot air;

a blowing fan to supply the hot air generated by the heater to the cooking chamber;

a first guide member to guide the hot air, supplied by the blowing fan, to be introduced into the cooking chamber; and a second guide member to guide and circulate the hot air along the heater, wherein the first guide member is arranged to extend in parallel to a direction of hot air flowing toward a hot air inlet provided at the heater casing to communicate with the cooking chamber so that it guides the hot air toward the hot air inlet, and the second guide members is arranged to extend inclinedly at a predetermined angle so that it guides the hot air to circulate along the heater, and wherein each first guide member is mounted, at one end thereof, to an inner peripheral surface portion of the heater casing near a corresponding through hole and to guide hot air discharged from a periphery of the heater to the cooking chamber through the corresponding through hole.

11. The wall-mounted microwave of claim 10, wherein each second guide member is mounted, at one end thereof, to the inner peripheral surface portion of the heater casing at a position relative to a corresponding first guide member and connected to an end thereof, to guide hot air discharged from a periphery of the heater to flow around the heater.

12. The wall-mounted microwave of claim 10, wherein corresponding first and second guide members form a triangular shape, along with an inner peripheral surface portion of the heater casing.

13. The wall-mounted microwave of claim 10, wherein the first and second guide members each comprises a predetermined width, to allow hot air to flow along a surface thereof.

* * * * *